United States Patent [19]

Machi et al.

[11] 3,990,892

[45] Nov. 9, 1976

[54] WEAR RESISTANT AND HEAT RESISTANT ALLOY STEELS

[75] Inventors: Hideo Machi; Jiichi Kitano, both of Toyama; Michio Hamamoto, Himi; Yasushi Koyanagi; Hiroshi Hirayama, both of Fujisawa, all of Japan

[73] Assignees: Kabushiki Kaisha Fujikoshi; Fuji Valve Kabushiki Kaisha, Tokyo, both of Japan

[22] Filed: Jan. 17, 1975

[21] Appl. No.: 541,997

Related U.S. Application Data

[63] Continuation of Ser. No. 343,365, March 21, 1973, abandoned.

[30] Foreign Application Priority Data

Mar. 28, 1972 Japan ..... 47-30316

[52] U.S. Cl. ..... 75/128 C; 75/126 C; 75/126 H; 75/126 Q; 75/128 B; 75/128 W

[51] Int. Cl.[2] ..... C22C 38/44

[58] Field of Search ..... 75/126 C, 126 H, 128 B, 75/128 W, 126 Q, 128 C

[56] References Cited

UNITED STATES PATENTS

| | | | |
|---|---|---|---|
| 1,630,448 | 5/1927 | Oertel | 75/126 H |
| 2,359,692 | 10/1944 | Trantin | 75/125 |
| 2,590,835 | 4/1952 | Kirkby | 75/126 H |
| 3,859,080 | 1/1975 | Mendelson et al. | 75/126 C |
| 3,876,475 | 4/1975 | Ramquist | 75/126 C |

*Primary Examiner*—Arthur J. Steiner
*Attorney, Agent, or Firm*—Flynn & Frishauf

[57] ABSTRACT

The alloy steel consists (by weight) of C 0.8–1.2%, Si 1.0–2.5%, Mn 0.2–1.0%, Cr 15.0–25.0%, one or both Ni 0.5–3.5% and Co 0.3–5.0%, where both Ni and Co are used, the sum of Ni and Co being 1.0–5.0%, one or both of Mo 0.3–3.5% and W 0.5–3.5%, when both Mo and W are used, the sum of Mo and W being 0.5–3.5% and the balance of Fe and inpurities. Where one, two or more of less than 0.5% of Al, less than 1.0% of Cu, less than 0.5% of V, less than 1.0% of Nb, less than 0.3% Ti, less than 0.25% of Zr, less than 0.2% of B and less than 0.3% of N are contained, the wear resistant and heat resistant property of the alloy can be improved further.

1 Claim, 4 Drawing Figures

WEAR RESISTANT AND HEAT RESISTANT ALLOY STEELS

This is a continuation of application Ser. No. 343,365, filed Mar. 21, 1973, now abandoned.

BACKGROUND OF THE INVENTION

This invention relates to wear and heat resistant steel alloys.

With recent strong requirement for preventing air pollution by the exhaust gas from internal combustion engines adapted to be mounted on vehicles, particularly motor cars, large efforts have been made to use fuels (gasoline) not containing a lead compound and to increase the temperature of combustion which is necessary to assure perfect combustion of the fuel. This increases the temperature of the exhaust gas thereby increasing the damage to valves and valve seats caused by the exhaust gas, which is a serious problem to be solved quickly in the art of internal combustion engines. Heretobefore valve seats have been made of copper alloy castings, cast iron, sintered alloys, heat resistant steel, etc. An alloy $SUH_4$ specified by JISG-4311 has also been used frequently. But the damage caused by the attempts for reducing pollution is too serious and any satisfactory solution has not yet been made.

SUMMARY OF THE INVENTION

It is an object of this invention to improve above described heat resistant alloy $SUH_4$ whereby to obtain a novel heat and wear resistant steel alloys which can eliminate the disadvantage of the conventional alloy steels.

The alloy steels of this invention are characterized in that they have an excellent workability as well as hot and cold plasticity, can be readily worked as by hot forging, hot and cold rolling, drawing, shearing and extension, that they have an adaptability for heat treatment, have uniform and stable structure, that the alloy steels are highly resistant to oxidation and corrosion caused high temperature exhaust gas exhausted from internal combustion engines (which contains hydrocarbons, oxides of carbon, oxides of nitrogen, etc. In the case of diesel engines the exhaust gas further contains oxides of sulfur, Vanadium oxide, etc. which are produced by the combustion of fuel oils), that the steel alloys have excellent mechanical characteristic at high temperatures, high fatigue strength, can retain hardness, that the alloys have improved heat conductivity and wear resistant property and that the alloys can be manufactured economically at low cost. Thus the steel alloys of this invention are particularly suitable to manufacture valve seats, particularly valve seats of exhaust valves, of internal combustion engines.

The alloy steel of this invention consists of C 0.8–1.2%, Si 1.0–2.5%, Mn 0.2–1.0%, Cr 15.0–25.0%, one or both of Ni 0.5–3.5% and Co 0.3–5.0%, where both Ni and Co are used, the sum of Ni and Co being 1.0–5.0%, one or both of Mo 0.3–3.5 and W 0.5–3.5%, where both Mo and W are used, the sum of Mo and W being 0.5–3.5% and the balance of impurities and Fe. If desired, one, two or more of less than 0.5% of Al, less than 1.0% of Cu, less than 0.5% of V, less than 1.0% of Nb, less than 0.3% Ti, less than 0.25% of Zr, less than 0.2% of B and less than 0.3% of N may be added to the composition described above. It is to be understood that all parts are herein based on weight percent.

The ranges of respective components are specified on the following grounds.

C combines with carbide forming elements W, Mo and Cr to form hard carbides. By quenching, a portion of carbon forms a solid solution in austenite, thus forming martensite which is effective to harden the matrix. When tempered, fine particles of carbides precipitate uniformly, thereby causing precipitation hardening to improve the wear resistant, property, high temperature hardness as well as high temperature strength. Carbon of less than 0.8%, by weight, is not suitable because such low carbon content results in nonuniform tempered structure and the alloy contains ferrite phase, thereby the wear resistant property, high temperature hardness and high temperature strength are decreased.

Even when the C content is less than 0.8%, by increasing the Ni content it is possible to prevent formation of nonuniform structure, but this will decrease the hardness as tempered. Especially, when the contents of W and Mo added are increased the nonuniformity of the structure is enhanced. This requires to increase the contents of Ni, Co and C. On the other hand, while increase in the C contents is effective to increase the uniformity of the structure, the hardness as tempered and the wear resistant property, when C contents exceeds 1.2%, the hot and cold plasticity and the workability or cutting ability are impaired.

Si improves the antioxidation property as well as corrosion resistant property. However, Si of less than 1.0% does not produce these desirable properties. Although, when Si contents is increased these properties and the wear resistant property are improved. Si contents of more than 2.5% increases the brittleness of the steel alloy and decrease the hot and cold plasticity.

Like Ni, and Co, Mn is effective to homogenize the tempered structure when the Mn content is increased resistance to oxidation is decreased. Moreover, excess Mn contents stabilizes the austenite phase of the hardened structure and degrades the heat treating property.

Mn is an indispensable element as a deoxidizing agent of the steel bath and as an agent for preventing excessive oxidation during refining of steel. For the reason described above, Mn content is limited within a range of from 0.2 to 1.0%.

Cr is an efficient element for forming carbides. In addition it improves wear resistant property, hardenability, antioxidation and corrosion resistant properties and high temperature strength so that Cr is an indispensable element for heat resistant and wear resistant steel alloys. However, Cr of less than 15% is not effective to improve antioxidation and corrosion resistant properties. This difficulty can be overcome by increasing Cr. However, increase of Cr alone results in the increase of the ferrite phase thus losing uniformity of the structure. For this reason, it is also necessary to increase the contents of C, Ni, Mn and Co. The addition of Cr in excess of 25% is not suitable because it impares hot and cold plasticity.

Although Ni is effective to improve corrosion resistant property, it is not so efficient to increase antioxidation property, high temperature strength as well as wear resistant property. However, Ni is effective to homogenize and stabilize the structure of the steel alloy, and to improve the strength against heat impact and thermal fatigues. On the other hand, Ni permits corrosion of the steel alloy by sulfur in a sulfur containing atmosphere thereby greatly decreasing the resistance against oxidation and corrosion.

Like Ni, Co is effective to stabilize and homogenize the tempered structure and to suppress the formation of the ferrite phase, but its efficacy is not so remarkable as Ni. Further, it has no effect for lowering the hardening temperature. However, Co is more efficient to improve the high temperature strength than Ni and can improve the antioxidation and corrosion resistant properties. In this invention the influence of Co is substantially equivalent to that of Ni but is superior to Ni in that it is free from the adverse phenomenon of the corrosion caused by sulfur occurring in a sulfur containing atmosphere.

In this invention, Ni and/or Co are essential elements for the stabilization and homogenization of the alloy structure, so that either one or both of Ni and Co are added. In diesel engines which utilize sulfur rich fuels it is advantageous to use Co alone for the steel alloys intended to make valve seats.

The use of Ni of less than 0.5%, Co of less than 0.3%, and the sum of Ni and Co of less than 1.0% can not attain the object of this invention. Where a small content of Ni alone is added, it is necessary to increase the C content or to decrease the Si, Cr, Mo and W contents. As the Ni addition content is increased, the quantity of retained austenite in the hardened structure is increased which is difficult to be decomposed by tempering. A excess addition of Ni content also increases the hardness as annealed, and decreases cold plasticity as well as hot plasticity, so where Ni alone is added, addition of Ni in excess of 3.5 is of low practical valve and is expensive.

Similar to Ni, where a small content of Co is added, it is necessary to increase the C content or to decrease the contents of W, Mo, Cr and Si. However, the defect in the structure caused by the use of Co is not so serious as in the case of Ni. However, like Ni, the addition of Co in excess of 5% results in the increase in the hardness as annealed thereby decreasing the hot and cold plasticity. Moreover, manufacturing cost is increased.

The contents of Co and Ni and of the sum of these two elements depend upon the contents of other alloying elements, that is C, Si, Cr, W and Mo. Thus, it is necessary to increase the contents of Ni and Co where the C content is small and where the contents of Si, Cr, W and Mo are large.

For this reason, in this invention, the contents of Ni and Co are limited such that, where Ni alone is added, the content thereof should be from 0.5 to 3.5%, where Co alone is added, the content thereof should be from 0.3 to 0.5% whereas when both Ni and Co are added, the content of the sum of these elements should be 1.0 to 5.0%.

Like Cr and Si, Mo and W are not only the ferrite forming elements but also extremely efficient carbide forming elements. Further, like V, Mo and W result in the precipitation hardening thereby strengthening the matrix which increases not only the high temperature hardness, high temperature strength but also creap strength. These improved properties improve the wear resistant property owe to the existance of hard carbides. Moreover, Mo and W improve the oxidation resistant and corrosion resistant properties of the steel alloy. While Mo is more effective than W for the purpose of improving oxidation resistant and corrosion resistant properties, high temperature strength and creap strength, if the addition content of Mo is increased beyond that required, the antioxidation property becomes lower than the case where W is added.

The addition of Mo of less than 0.3%, W of less than 0.5%, and the sum of Mo and W of less than 0.5% can not provide the required wear resistant property.

Where Mo or W or the sum of Mo and W is added in a content larger than that required, the formation of ferrite is promoted thereby decreasing the homogeneousness and stability of the structure. This requires higher hardening temperature and fails to provide an appropriate hardness as tempered thereby greatly decreasing the wear resistant property. Such disadvantages can be overcome by increasing the C contents and increasing the Ni contents or Co or both which act as the austenite forming elements, but increase in the contents of Ni or Co or both is limited by the reason described hereinbefore. Furthermore, addition of Mo or W or both in excess of that required decreases hot and cold plasticity, increases the hardness after annealing and decreases workability. This of course increases the cost.

For the reason described above, in this invention the contents of Mo and W are limited such that where Mo alone is incorporated, Mo contents is limited to a range of 0.3–3.5%, where W alone is incorporated W contents is limited to a range of 0.5–3.5% and where both Mo and W are incorporated the sum of both is limited to a range of 0.5–3.5%.

As above described, in accordance with this invention it is possible to economically provide wear resistant and heat resistant steel alloys at a low cost by incorporating C, Si, Mn, Cr, Ni, Co, Mo and W at the prescribed proportions. Further, it is possible to improve the characteristics of the steel alloys by incorporating thereto one, two or more of Al, Cu, V, Nb, Ti, Zr, B and N.

Although Al has substantially the same effect as Si, its quantity may be small. However, Al decreases the fluidity of molten steel and is chemically active. When Al content is increased, it is necessary to use special melting technique such as vacuum melting technique. Since such a special melting technique is not economical, with conventional melting technique, the upper limit of Al is 0.5%. Further, Al is used as a deoxidation agent during steel manufacturing. In this invention Al contents is limited below 0.5%.

Cu has substantially the same effect as Ni and Co. Thus, Cu is effective to increase antioxidation property and corrosion proof property and stabilizes and homogenizes the structure. However, when Cu content incorporated exceeds 0.5%, the resulting product becomes brittle at elevated temperatures and decreases hot plasticity. Since the steel alloys of this invention contains Ni and Co which alleviate the brittleness at elevated temperatures it is possible to increase Cu. But Cu contents exceeding 1.0% is not advantageous.

V, Nb, Ti, Zr and B are efficient elements that can form carbides and are chemically active. Like Mo and W, the incorporation of these elements not only increases the wear resistant property and high temperature strength but also homogenizes the structure. However, when the V contents exceeds 0.5%, the effect of vanadium attack becomes serious thereby decreasing the antioxidation property. For this reason, the V contents should be less than 0.5%.

Although Nb does not impair the antioxidation property as V does and is effective to provide a homogeneous structure, it is expensive. Since even when a large Nb contents is used, no additional advantages are obtained, its quantity is limited to be less than 1.0%.

Most proportions of incorporated Ti are present in the form of carbides or nitrides which are effective to increase wear resistant property. However, since Nb decreases the fluidity of molten steel and since it is chemically active, it is necessary to use expensive vacuum melting technique. Moreover, as a large Ti contents impairs the quality of the steel alloy, its contents should be less than 0.3%.

Like Ti, most proportions of incorporated Zr are present in the form of carbides or nitrides which are effective to improve the wear resistant property. But Zr also requires a special steel making process so that with a conventional process of steel manufacturing it is necessary to limit the Zr contents. The Zr contents in excess of 0.25% is not only un-economical but also does not produce any advantageous merit.

Although B is effective to increase the high temperature strength, too much B contents lowers the melting point of the steel alloys and impairs the hot plasticity. For this reason, the B contents must be lower than 0.2%.

N is an element for forming the austenite phase and effective to stabilize the structure, improve the high temperature strength and to form nitride which functions to increase the wear resistant property. However, excess N contents increases the tendency of segregation thereby impairs homogeneousness. For this reason, the N contents should be less than 0.3%.

BRIEF DESCRIPTION OF THE DRAWINGS

The preferred embodiments of the invention will now be described with reference to the accompanying drawings which shows the result of comparison tests carried out on a control (SUH4B) and the steel alloy of this invention in which.

DESCRIPTION OF THE PREFERRED EMBODIMENTS

Various characteristics of the novel steel alloys A, B, C and D and controls X and Y consisting of heat resistant alloy SUSUH4B prepared in accordance with JISG. Tables 1 and 3 show the compositions of the novel steel alloys and the controls and Tables 2 and 4 show the heat treatment applied to test pieces. The test pieces for determining the wear resistant property were hardened according to the conditions shown in Table 4 and the hardness was adjusted by varying the annealing temperature.

COMPARISON EXAMPLE 1

Table 1

| | Chemical Composition | | | | | | | | | |
|---|---|---|---|---|---|---|---|---|---|---|
| | C | Si | Mn | Cr | Ni | Co | Mo | Cu | P | S |
| X | 0.78 | 2.16 | 0.42 | 19.63 | 1.32 | 0.02 | 0.02 | 0.05 | 0.016 | 0.006 |
| A | 1.01 | 2.06 | 0.42 | 20.00 | 0.10 | 1.82 | 1.06 | 0.04 | 0.016 | 0.025 |

Table 2

| | Heat Treatment and Hardness | | |
|---|---|---|---|
| | Hardening | Annealing | Hardness HRC |
| X | 1060° C, oil cooling | 700° C oil cooling | 33 – 35 |
| A | 1120° C, oil cooling | 740° C oil cooling | " |

Average wear of the valve seat made of control X per hour when operated with gasoline not containing any lead compound was 37 $\mu$ whereas that of the valve seat made of the novel steel alloy A was only 1 $\mu$. The test engine was a 1800 cc, 115 HP gasoline engine, the valve was 21–4N and the test period was 30 to 50 hours.

COMPARISON EXAMPLE 2

TABLE 3

| | Chemical Composition | | | | | | | | | | | |
|---|---|---|---|---|---|---|---|---|---|---|---|---|
| | C | Si | Mn | Cr | Ni | Co | Mo | W | Cu | V | P | S |
| Y | 0.83 | 2.12 | 0.47 | 19.65 | 1.44 | 0.08 | 0.08 | 0.07 | 0.05 | 0.07 | 0.023 | 0.012 |
| B | 0.97 | 2.07 | 0.44 | 20.05 | 0.05 | 2.05 | 1.12 | 0.05 | 0.03 | 0.08 | 0.028 | 0.028 |
| C | 1.00 | 1.91 | 0.41 | 19.35 | 2.03 | 0.08 | 1.02 | 0.06 | 0.05 | 0.08 | 0.014 | 0.014 |
| D | 1.03 | 2.07 | 0.43 | 20.60 | 1.51 | 0.86 | 1.05 | 1.50 | 0.04 | 0.06 | 0.016 | 0.016 |

TABLE 4

| | Heat Treatment and Hardness. | | | | |
|---|---|---|---|---|---|
| | Hardening | | Annealing | | Hardness HRC |
| Y | 1060° C | oil cooling | 700° C | oil cooling | 33 – 35 |
| B | 1120° C | " | 740° C | " | " |
| C | 1070° C | " | 720° C | " | " |
| D | 1050° C | " | 700° C | " | " |

Figure 1:
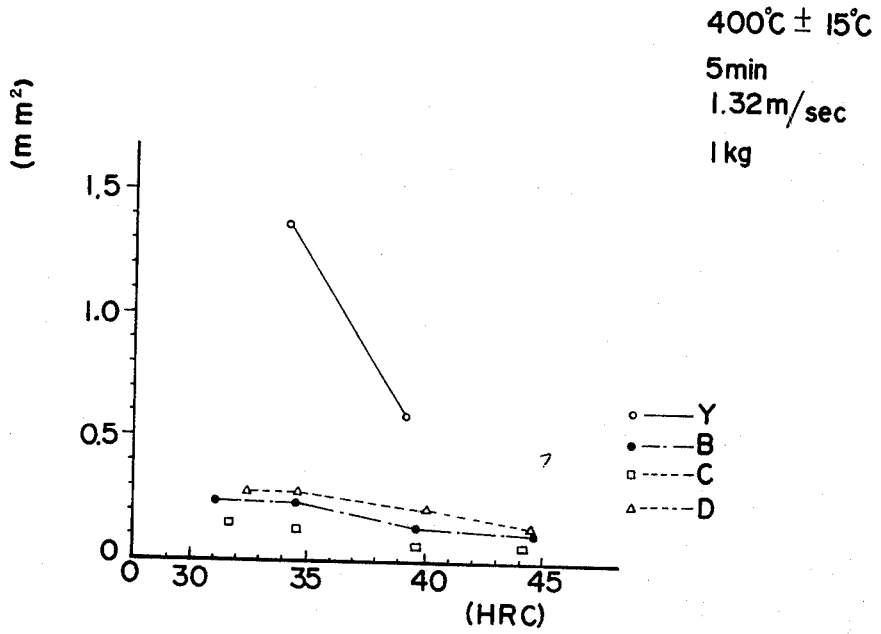
FIG. 1 is a graph showing the result of wear test.
Figure 2:
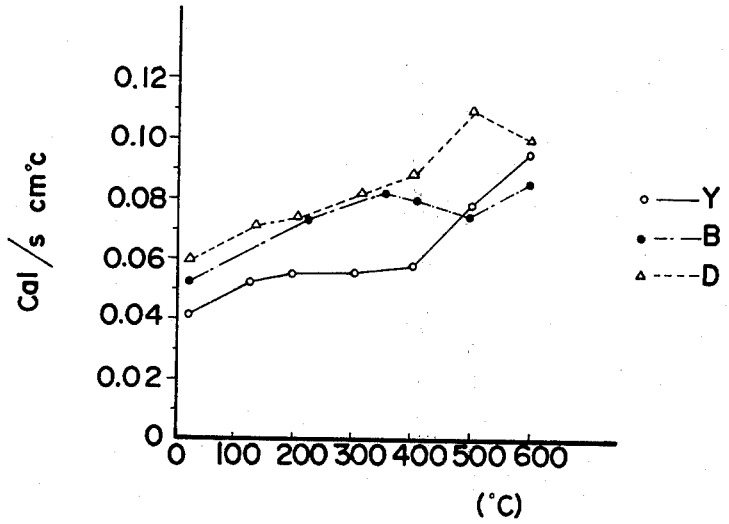
FIG. 2 is a graph showing the heat conductivity.
Figure 3:
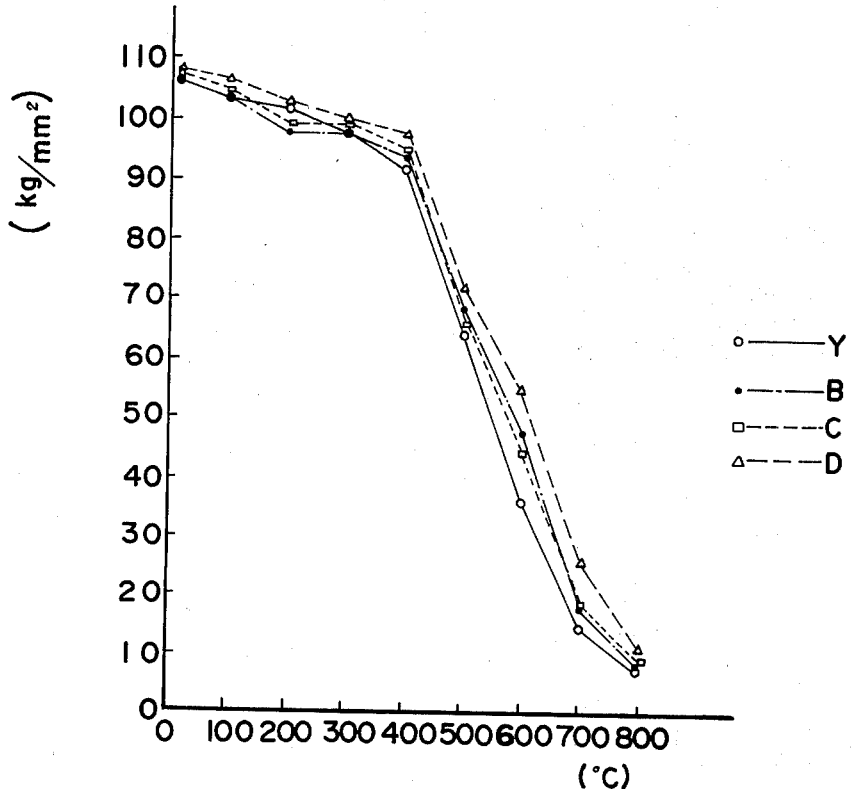
FIG. 3 is a graph showing the result of high temperature tensile test.
Figure 4:
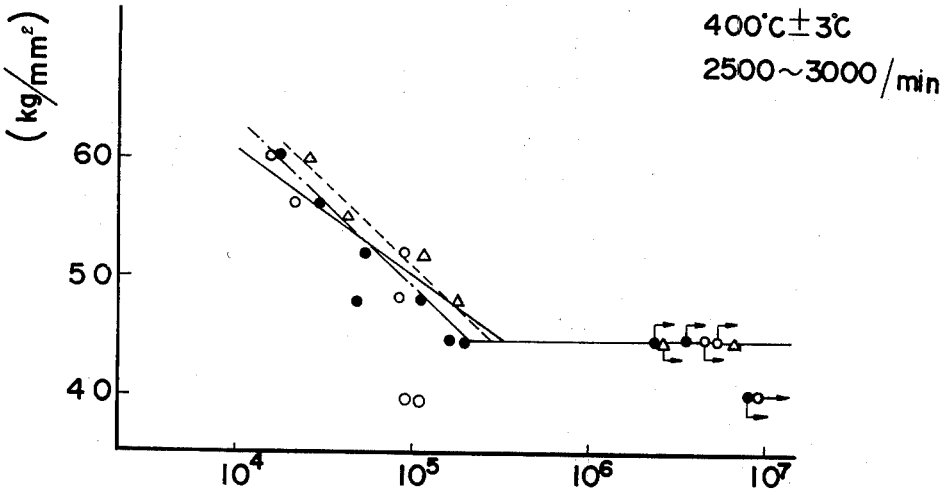
FIG. 4 is a graph showing the values of the fatigue strength under rotational torsion.

FIG. 1 shows the result of wear test made on the above described controls and the novel steel alloys. FIG. 2 shows a comparison of heat conductivity. FIG. 3 shows the test result of high temperature tensile test and FIG. 4 shows the fatigue strength under rotational bending. In these Figures, Y shows the control and B, C and D the steel alloy of this invention.

As can be noted from these drawings, the steel alloys of this invention have very small wear irrespective of the hardness after heat treatment and high heat conductivity. Further, it can be noted that the novel steel alloys have sufficiently high temperature strength and fatigue strength which are comparable with those of the controls. These advantageous merits can be attributed to Mo and W which are incorporated in addition to Cr and Si. Further, contents of C, Ni and Co balanced with those of Cr, Si, Mo and W are effective to homogenize and stabilize the structure. Mo and W greatly improves the wear resistant property at elevated temperatures thereby elongating the useful life of the wear resistant and heat resistant steel alloys.

While the steel alloys of this invention are suitable for the manufacture of valve seats, particularly the valve seats of the exhaust valves of internal combustion engines it should be understood that the novel steel alloys can also be used in many other applications where high wear resistant property is required.

What is claimed is:

1. A wear resistant and heat resistant alloy consisting of, in weight percent:

| | |
|---|---|
| C | 0.8–1.2 |
| Si | 1.0–2.5 |

-continued

| | |
|---|---|
| Mn | 0.2–1.0 |
| Cr | 15.0–25.0 |
| Ni | 0.5–3.5 |
| W | 0.5–3.5 |
| Al | <0.5 |
| Cu | <1.0 |
| V | <0.5 |
| Nb | <1.0 |
| Ti | <0.3 |
| Zr | <0.2 |
| B | <0.2 |
| N | <0.3 |
| Fe and incidental impurities | Balance. |

* * * * *